US007150063B1

(12) United States Patent
Graham

(10) Patent No.: US 7,150,063 B1
(45) Date of Patent: Dec. 19, 2006

(54) VEHICLE WASH MITT

(76) Inventor: Scott Graham, 1001 Laird Ave., Parkersburg, WV (US) 26101

( * ) Notice: Subject to any disclaimer, the term of this patent is extended or adjusted under 35 U.S.C. 154(b) by 634 days.

(21) Appl. No.: 09/524,612

(22) Filed: Mar. 14, 2000

(51) Int. Cl.
*A46B 17/04* (2006.01)

(52) U.S. Cl. ..... 15/160; 15/210.1; 15/247; 15/244.3; 401/268; 401/24; 401/289; 401/269

(58) Field of Classification Search ..... 15/247, 15/227, 228, 244.3, 235, 160, 210.1; 401/268, 401/24, 289, 291, 269, 201, 261
See application file for complete search history.

(56) References Cited

U.S. PATENT DOCUMENTS

| | | | | | |
|---|---|---|---|---|---|
| 1,334,911 | A | * | 3/1920 | Lampkin | 401/266 |
| 2,571,606 | A | * | 10/1951 | Peterson | 15/227 |
| 2,709,824 | A | * | 6/1955 | Hall | 15/247 |
| 2,875,460 | A | * | 3/1959 | Legge | 15/114 |
| 2,942,287 | A | * | 6/1960 | Parmet | 15/247 |
| 2,963,731 | A | * | 12/1960 | Hoots | 15/247 |
| 2,984,854 | A | * | 5/1961 | Johnson | 15/235 |
| 3,100,905 | A | * | 8/1963 | Salick | 15/235 |
| 3,589,819 | A | | 6/1971 | Bryant | 401/7 |
| 3,761,991 | A | * | 10/1973 | Moss | 15/229.11 |
| 4,066,366 | A | * | 1/1978 | Reynolds | 401/285 |
| 4,339,850 | A | | 7/1982 | Altman et al. | 17/69 |
| 4,696,593 | A | | 9/1987 | Bayless | 401/7 |
| 4,902,153 | A | | 2/1990 | Luke | 401/131 |
| 4,953,998 | A | | 9/1990 | McCartherens | 401/7 |
| 4,961,662 | A | | 10/1990 | Chow et al. | 401/42 |
| 5,177,831 | A | * | 1/1993 | Wirth | 15/244.3 |
| 5,373,601 | A | | 12/1994 | Miller | 15/118 |
| 5,441,355 | A | | 8/1995 | Moore | 401/7 |
| 5,718,016 | A | | 2/1998 | Sung | 15/339 |
| 5,924,153 | A | | 7/1999 | Salley | 15/1.52 |

FOREIGN PATENT DOCUMENTS

| | | | | |
|---|---|---|---|---|
| FR | 1252344 | * | 12/1960 | 15/247 |
| GB | 481824 | * | 3/1938 | 15/247 |

* cited by examiner

*Primary Examiner*—Gary K. Graham
(74) *Attorney, Agent, or Firm*—Connolly Bove Lodge & Hutz LLP

(57) ABSTRACT

A vehicle washing mitt for covering vehicle washing brushes, such as those at self-service car washes. The mitt is shaped to effectively cover the vehicle washing brush while it is in use. The material used to form the mitt has a soft fibrous external outside and is secured on to the brush with a fastener. Methods of washing a vehicle by using the mitt.

4 Claims, 4 Drawing Sheets

VEHICLE WASH MITT

BACKGROUND OF THE INVENTION

1. Field of the Invention

This invention relates to manual vehicle washing devices, more specifically a protective mitt for covering manual vehicle wash brushes.

2. Description of the Related Art

Foaming brushes used at self-service car washes are typically a brush connected to a wand pipe. A soapy lather is dispensed through the brush. An example of one is shown in FIG. 1. The lather serves to loosen and remove dirt and substances from the exterior of the car as well as provide lubrication for the brush. Typically bristles used for brushes include plastics such as PROLENE®, NYLEX®, nylon, or hog hair bristle.

Such foaming brushes have disadvantages in their use. Foaming brushes can be ineffective in removing the film that is left behind by dirt, dust and exposure to the elements, as well as by the soap used to wash the vehicle. These brushes have a tendency to scratch vehicles with their bristles. They are also can trap dirt particles such as sand and other miscellaneous particles that tend to scratch vehicles.

The prior art discloses various car washing devices. For example, U.S. Pat. No. 3,589,819 discloses a car wash mitt that has a water supply attached to it and is worn on the hand of the user. The water is supplied to the mitt via a central receptacle. A foraminous base plate causes the water exiting the mitt to be evenly spread. The base plate is removable and allows the loading of a soap bar or pellet into the receptacle so that soapy water can be discharged. When the user desires to rinse the soapy water off of the car, the baseplate is once more removed thereby permitting the removal of the soap.

U.S. Pat. No. 4,696,593 discloses a car wash mitt that is adapted to be worn on the hand of the individual user. The mitt is formed from sponge material and has a liquid soap reservoir. The glove is supplied with water by a flexible hose. The glove can be connected to a garden hose to provide a source of water.

U.S. Pat. No. 4,961,662 discloses a brush head carrier for attachment to a faucet by means of a hose to permit the flow of water through the brush head carrier. A plurality of separately useable brush heads are individually removably mounted on the carrier at a relatively wide opening at the surface of the carrier.

U.S. Pat. No. 5,373,601 discloses a washing mitt that allows the user's hand to fit into the inner end of the sleeve. The sleeve is designed to prevent the accidental rotation of the mitt on the hand of the user.

This prior art does not teach or suggest a device that is more effective in removing the dirty film that can be left behind by a bristle brush. There is no teaching from this prior art of a device that prevents the scratching associated with that of a bristle brush.

SUMMARY OF THE INVENTION

In accordance with the present invention a vehicle washing mitt has been developed for covering vehicle washing brushes, for use on brushes used to wash vehicles, such as those at self-service car washes.

The use of the term "vehicle" includes any type of vehicle that has an exterior in need of washing. Such vehicles include consumer vehicles such as cars, sports utility vehicles, pick up trucks, minivans, vans, recreational vehicles, mobile homes, motorcycles, etc. Vehicle may also include vehicles that are used for commercial purposes such as vans, minivans, trucks, buses, etc. Other vehicles used for transportation such as boats, airplanes or military vehicles are also contemplated for use with this invention.

The term "self-service vehicle wash" includes any vehicle washing facility where vehicles are regularly washed manually. A typical example of a self-service vehicle wash is a self-service car wash that is business that is open to the public, where patrons pay for certain amount of time to use the facilities. Self-service vehicle washes also exist at private, government or military institutions where a large number of vehicles are regularly washed. For example, race tracks have such self-service vehicle washes for the washing of race cars. Airports and harbors also have self-service vehicle washes for the washing of airplanes and boats, respectively. A self-serve vehicle washing station typically provides brushes that attach to the end of a wand which is secured to the end of hose. Soapy water is passed through the hose at a high rate of pressure and dispersed through the brush onto the vehicle. Rinse water can then be passed through the wand to rinse the vehicle.

These together with other various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and advantages other than those set forth above will become apparent when consideration is given to the following detailed description thereof. Such description makes reference to the annexed drawings wherein.

DETAILED DESCRIPTION OF THE PREFERRED EMBODIMENTS

Reference now will be made in detail to the present preferred embodiments of the present invention, examples of which are illustrated in the accompanying drawings.

Figure 1:
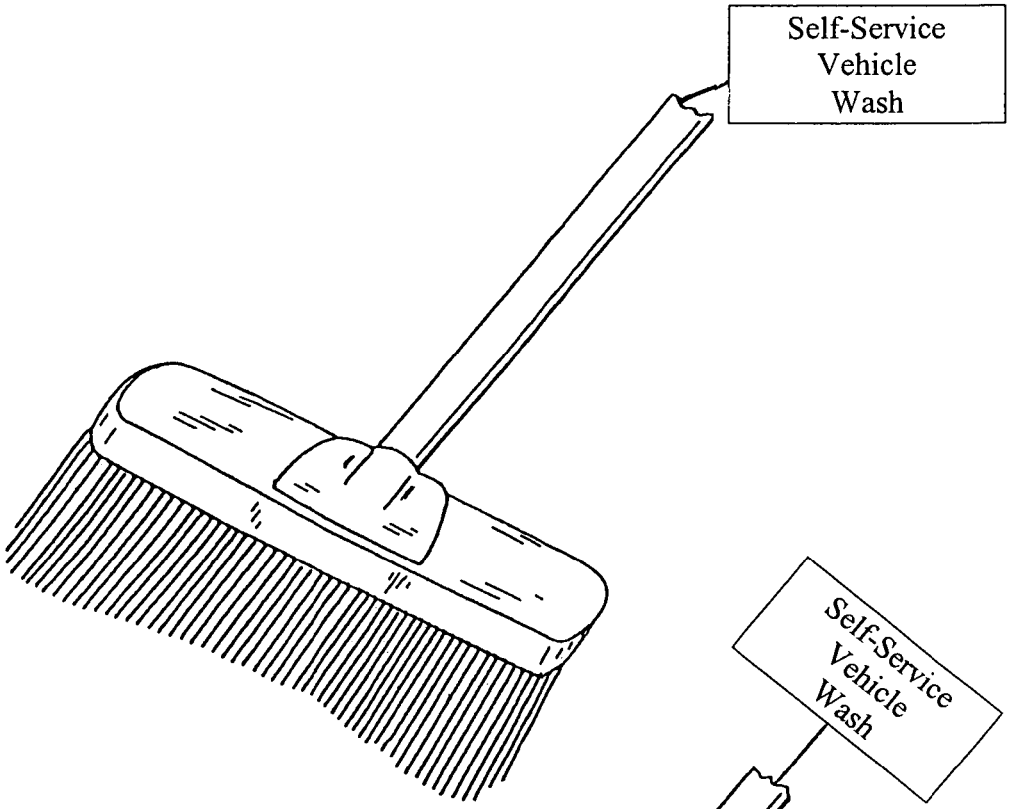
PRIOR ART FIG. 1
FIG. 1 is a perspective representation of a prior-art vehicle washing brush.
Figure 2:
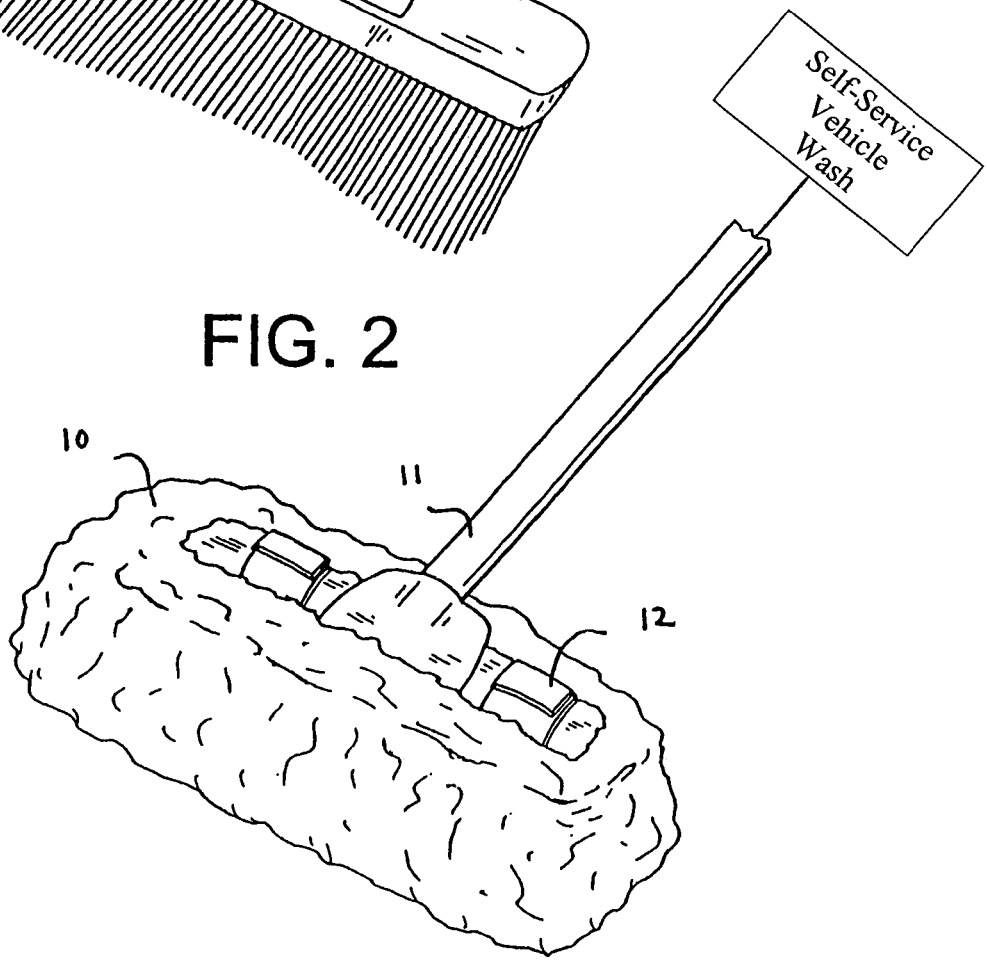
FIG. 2 is a drawing is a perspective representation of a the present invention covering the brush of FIG. 1.

FIG. 2 shows the mitt 10 covering a typical brush 11 used at a vehicle wash facility such as a self-service car wash. The mitt 10 is secured over the brush 11 by use of VELCRO straps 12 that are sewn into the material of the mitt 10. The mitt 10 is preferably made from a sheet-like material having two surfaces on which one surface is made up of soft fibers and the other surface is smooth. Examples of such material are sherpa or sheepskin. Sherpa is considered advantageous because it is better able to endure repeated us and exposure to an outside environment than sheepskin. Various grades of sherpa are contemplated for use in the invention, for example 60 oz. sherpa, although heavier or lighter grades of sherpa are also contemplated, such as sherpa grades between 20 to 60 ozs. Examples of such grades in this range of sherpa are well known in the art and include 20, 32, 44, 51 and 60 oz. grades. The material that the mitt 10 is made of is capable of allowing the passage of the soapy water that is being ejected from the brush and have a fiber-filled surface external to that of the brush. The fibers are preferably capable of washing the surface of a car or other vehicle without causing undue scratching. Also, an advantage of such soft fibrous material is that it is able to better remove fine dirt and dust as well as any soap scum that a brush might leave behind.

Figure 3:
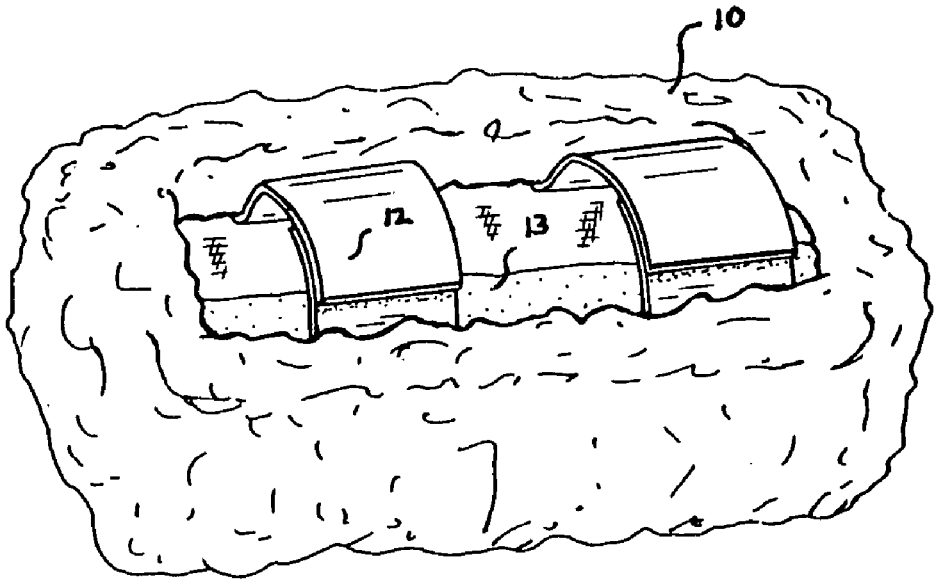
FIG. 3 is a top rear perspective representation of the present invention.

The invention is made by cutting a pattern of the selected material in a shape capable of being sewn into an open box shape. An example of the dimensions of such an open box is 9"1×3" w×3.5" h. In one embodiment of the invention, a foam pad 13 as shown in FIG. 3 may be sewn onto the surface opposite that of the fibrous material so that the foam pad 13 will be at the base of the open box shape. The foam pad 13 serves to aid in suds formation and to evenly disperse the water. In another embodiment, the foam pad is not used. The mitt 10 is not limited to a box shape, but rather may be made into any shape that can suitably fit around a vehicle washing brush, such as in a circular shape to fit around a circular brush.

Figure 4:
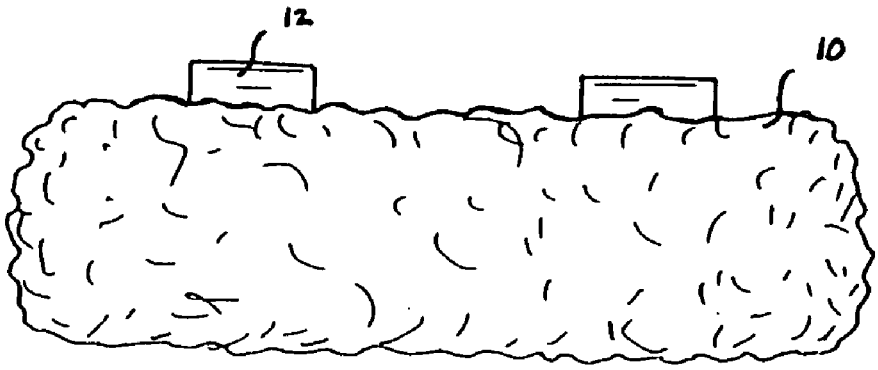
FIG. 4 is a front view thereof.
Figure 5:
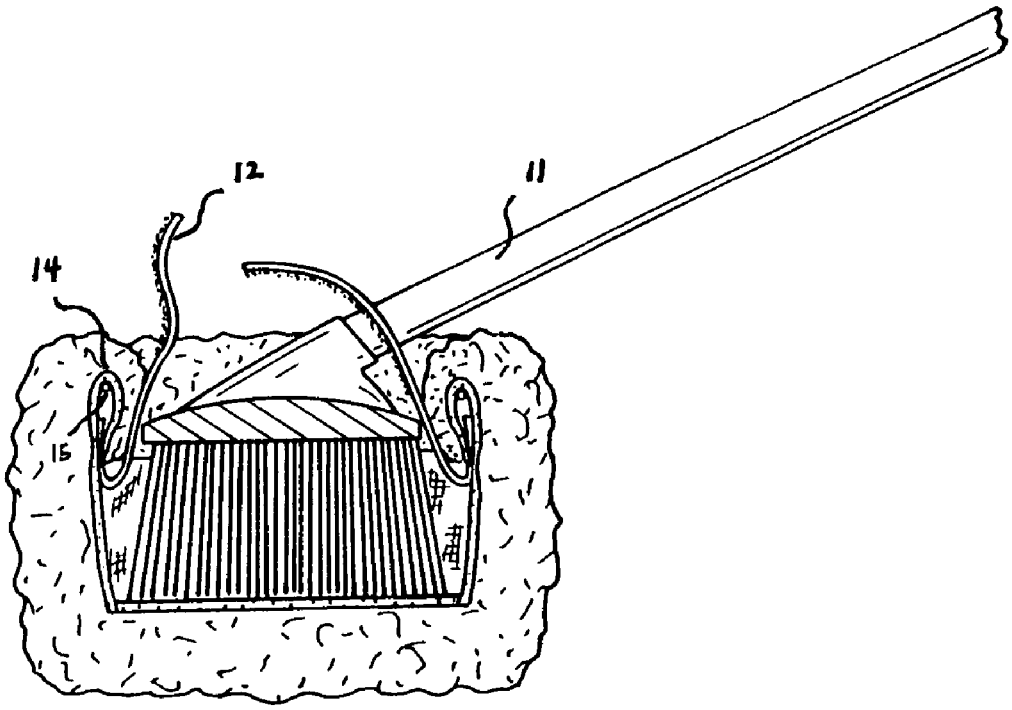
FIG. 5 is a cross-sectional view of FIG. 2.

As shown in the cross-sectional diagram of FIG. 5, the upper part of the material forms a hem 14 that serves to secure the velcro straps 12. The foam pad is not used in the embodiment of FIG. 5. The hem 14 provides a durable edge and anchors the velcro straps. Inside the hem 14 an elastic material, such as a shock cord 15 may be placed to aid the mitt 10 in forming a secure seal over the brush. The velcro straps 12 may be replace by any other suitable fasteners such as string or rope or any other material capable of being tied, or straps that fasten with buttons or buckles. Although two straps are shown in FIGS. 2–4, a single strap or more than three straps may be used as long as the mitt 10 is secured on the brush in a way that allows the mitt 10 to remain on the brush while water is being discharged through the brush. Likewise, there may be one or more fasteners such as belts, straps or material capable of being tied together, such as rope or string.

Figure 6:
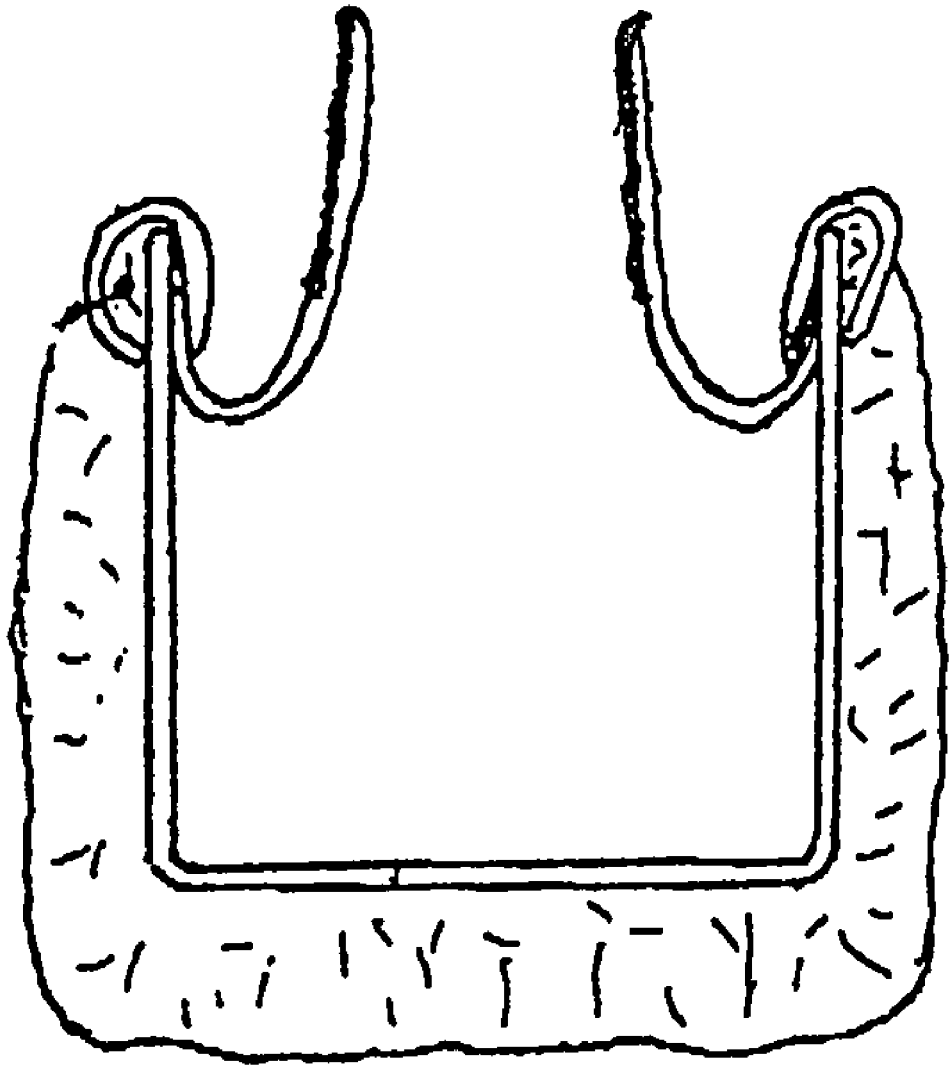
FIG. 6 is a cross-sectional view of a second embodiment of the invention.

FIG. 6 is a cross-sectional view of an alternative embodiment where the VELCRO® straps 12 are attached to the top of the mitt 10 without the use of a hem 14. On the top edge of the mitt 10, an elastic sheet 16 approximately two inches wide and long enough to cover the mitt 10, an elastic sheet 16 approximately two inches wide and long enough to cover the mitt 10 is folded in half over the top edge of the mitt 10. The edges of the VELCRO® straps 17 are placed under the elastic sheet and the elastic sheet and strap edges are sewn together into the mitt 10.

While the present invention is especially suited for use in covering brushes at self-service car washes, it is not limited to such uses. For example, the mitt 10 may be used on someone's hand. The hand is inserted into the compartment where the brush is able to fit into and secured by the use of the VELCRO® straps 12 or other such fasteners.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mitt removably associated with a vehicle washing brush comprising:

a material formed into the approximate shape of said washing brush, wherein said material is capable of fitting around said washing brush, and said material has a first surface facing and in contact with said washing brush, and a second surface opposite said first surface facing away from said washing brush, and wherein said second surface is woven with fibers capable of washing a surface of a vehicle, and said material is capable of allowing the passage of water from said washing brush;

a fastener capable of securing said mitt onto said brush while water passes through said washing brush wherein said fastener comprises at least one VELCRO® strap.

2. A mitt removably associated with a vehicle washing brush comprising:

a material formed into the approximate shape of said washing brush, wherein said material is capable of fitting around said washing brush, and said material has a first surface facing and in contact with said washing brush, and a second surface opposite said first surface facing away from said washing brush, and wherein said second surface is woven with fibers capable of washing a surface of a vehicle, and said material is capable of allowing the passage of water from said washing brush;

a fastener capable of securing said mitt onto said brush while water passes through said washing bush wherein said fastener comprises at least one pair of pieces of material capable of being tied, fastened, buckled or buttoned together.

3. A foaming brush mounted to a self-service car wash comprising a removable mitt according to claim 2.

4. A mitt removably associated with a vehicle washing brush comprising:

a material formed into the approximate shape of said washing brush, wherein said material is capable of fitting around said washing brush, and said material has a first surface facing and in contact with said washing brush, and a second surface opposite said first surface facing away from said washing brush, and wherein said second surface is woven with fibers capable of washing a surface of a vehicle, and said material is capable of allowing the passage of water from said washing brush;

a fastener capable of securing said mitt onto said brush while water passes through said washing brush wherein said material is sherpa or sheepskin.

* * * * *